US010520276B2

(12) United States Patent
Liao

(10) Patent No.: US 10,520,276 B2
(45) Date of Patent: Dec. 31, 2019

(54) AUTOMATIC MAGAZINE EJECTION STRUCTURE

(71) Applicant: GUAY GUAY TRADING CO., LTD., Changhua County (TW)

(72) Inventor: Yin-Hsi Liao, Changhua County (TW)

(73) Assignee: GUAY GUAY TRADING CO., LTD., Changhua County (TW)

( * ) Notice: Subject to any disclaimer, the term of this patent is extended or adjusted under 35 U.S.C. 154(b) by 0 days.

(21) Appl. No.: 16/234,525

(22) Filed: Dec. 27, 2018

(65) Prior Publication Data

US 2019/0234705 A1 Aug. 1, 2019

(30) Foreign Application Priority Data

Jan. 26, 2018 (TW) ..... 107201331 U

(51) Int. Cl.
*F41B 11/00* (2013.01)
*F41B 11/55* (2013.01)

(52) U.S. Cl.
CPC ..... *F41B 11/55* (2013.01)

(58) Field of Classification Search
CPC ..... F41B 11/50; F41B 11/55
See application file for complete search history.

(56) References Cited

U.S. PATENT DOCUMENTS

| | | | | |
|---|---|---|---|---|
| 6,694,658 | B1 * | 2/2004 | Marsac | F41B 7/006 124/16 |
| 8,011,355 | B2 * | 9/2011 | Kawashima | F41B 11/55 124/57 |
| 2014/0096755 | A1 * | 4/2014 | Larmer | F41B 11/55 124/52 |
| 2015/0176941 | A1 * | 6/2015 | Pullens | F41B 11/50 124/45 |
| 2018/0202750 | A1 * | 7/2018 | Willson | F41B 11/55 |

* cited by examiner

*Primary Examiner* — John A Ricci
(74) *Attorney, Agent, or Firm* — Leong C. Lei

(57) ABSTRACT

An automatic magazine ejection structure is combinable with a toy gun body that includes an action structure and includes: a magazine receptacle, at least one pellet holder for receiving BBs or pellets, a holder latch, a pellet advancing member, a pellet-advancing elastic member, an extendible pushing rod, and at least one action driving section. When the BBs or pellets have been completely shot out, the pellet advancing member pushes the extendible pushing rod to partly project out of one side of the holder latch. Then, an operation of backward pulling the action structure synchronously drives the extendible pushing rod to move backward so as to release retaining engagement of the holder latch thereby allowing the pellet holder to automatically eject out of the magazine receptacle. As such, the operation is made simple and simulation of an operation of an actual firearm is enhanced.

9 Claims, 11 Drawing Sheets

AUTOMATIC MAGAZINE EJECTION STRUCTURE

TECHNICAL FIELD OF THE INVENTION

The present invention relates generally to an automatic magazine ejection structure, and more particularly to a structure for automatically ejecting a magazine of which operation is simplified and shows high degree of reality simulation of operations of loading and ejecting ammunition.

DESCRIPTION OF THE PRIOR ART

Toy guns are often made for simulating real ones and may have difference in the structure of magazine due to the ammunition used. For a real gun, cartridges generally made up of a case and a bullet and the magazines are structured to match the cartridges. On the other hand, for a toy gun, a magazine is structured to contain and hold for example BBs or pellets by means of elastic tracks. For the purposes of simulation of the real guns, this invention is made to provide a technical breakthrough that imposes a true perception of operation in loading ammunition into the magazine of a toy gun.

The perception of operation of loading actual ammunition is different for different types of firearms. Some firearms are provided with a detachable magazine and efficient replenishment of ammunition is achieved through substitution of the magazine. Detaching the magazine is realized through operating a magazine latch. Such an operation of substituting the magazine does not work for some other types of firearms, such as Karabiner 98 kurz (which is often abbreviated as Kar98k and is a shell ejection riffle used in World War II). Such a kind of firearms has a magazine built in the internal and cartridges can be loaded into the internal magazine one by one. This causes difficulty in simulating the true perception of ammunition loading.

SUMMARY OF THE INVENTION

The primary objective of the present invention is to make use of an operation of an action to drive a cartridge latch to eject a pellet holder so as to achieve operation simplification and better simulation of an action of a real gun for operation so that an operation of driving caused by the automatic ejection of the pellet holder provides a high degree of simulation of firearm ammunition loading operation for direct loading of ammunition.

To achieve the above objective, the present invention is combinable with a toy gun body that comprises an action structure and generally comprises: a magazine receptacle formed in an interior of the toy gun body. At least one pellet holder that receives and holds at least one BB or pellet is arranged in the magazine receptacle in an elastic manner. A holder latch is pivotally arranged at one side of the pellet holder in an elastic manner to selectively engage and retain the pellet holder to prevent ejection thereof out of the magazine receptacle. Further, a pellet advancing member is arranged in the pellet holder in an elastic manner to outward feed the BB or pellet. A pellet-advancing elastic member is arranged inside the pellet holder and is connected to a bottom of the pellet advancing member. An extendible pushing rod is arranged on the holder latch in an elastic manner and is movable by means of being pushed by the pellet advancing member to partly project out of one side of the holder latch. At least one action driving section is arranged at one side of the action structure.

A user, when operating the present invention in simulating an operation of a firearm, may use an operation of loading the pellet holder into the magazine receptacle to simulate an actual operation of cartridge loading, and during a shooting process of the BBs or pellets, the pellet-advancing elastic member is operated to push the pellet advancing member upward in a step by step manner in order to contact and push the extendible pushing rod after the BBs or pellets have all been shot. Under such a condition, the user only needs to pull backward the action structure to cause the action driving section to drive the extendible pushing rod to move backward thereby releasing retaining engagement of the pellet holder by the holder latch so as to allow the pellet holder to automatically eject out of the magazine receptacle. As such, manually detaching the magazine is avoided and high degree simulation of a firearm ammunition loading operation of a direct loading type can be achieved.

With the above-described technique, the problems of the prior art that a magazine must be manually detached in simulating the perception of operation of actual ammunition loading, which causes complication of operation and simulation of cartridge loading is poor can be overcome.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
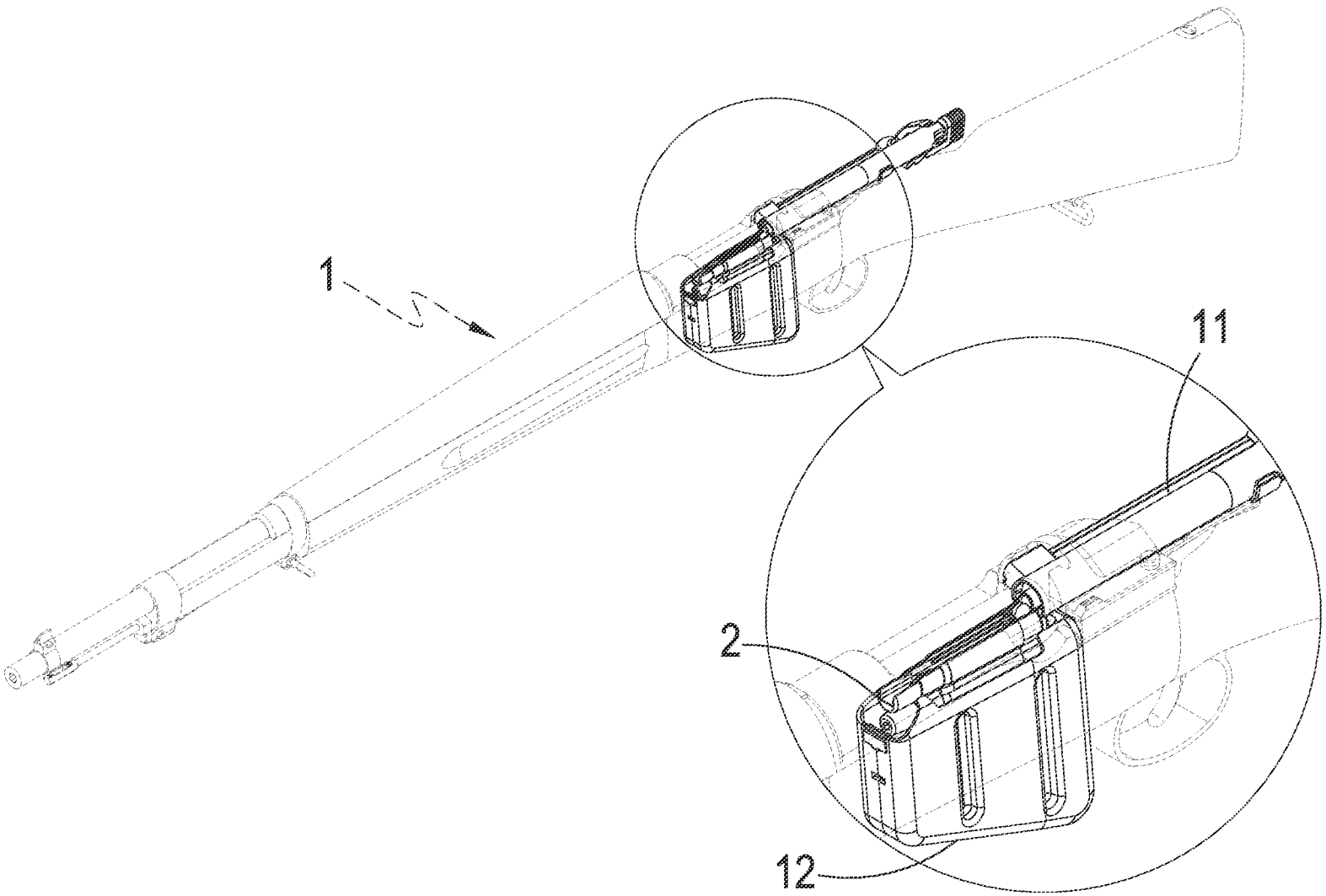
FIG. 1 is a perspective view, partly seeing through, showing a preferred embodiment of the present invention.
Figure 2:
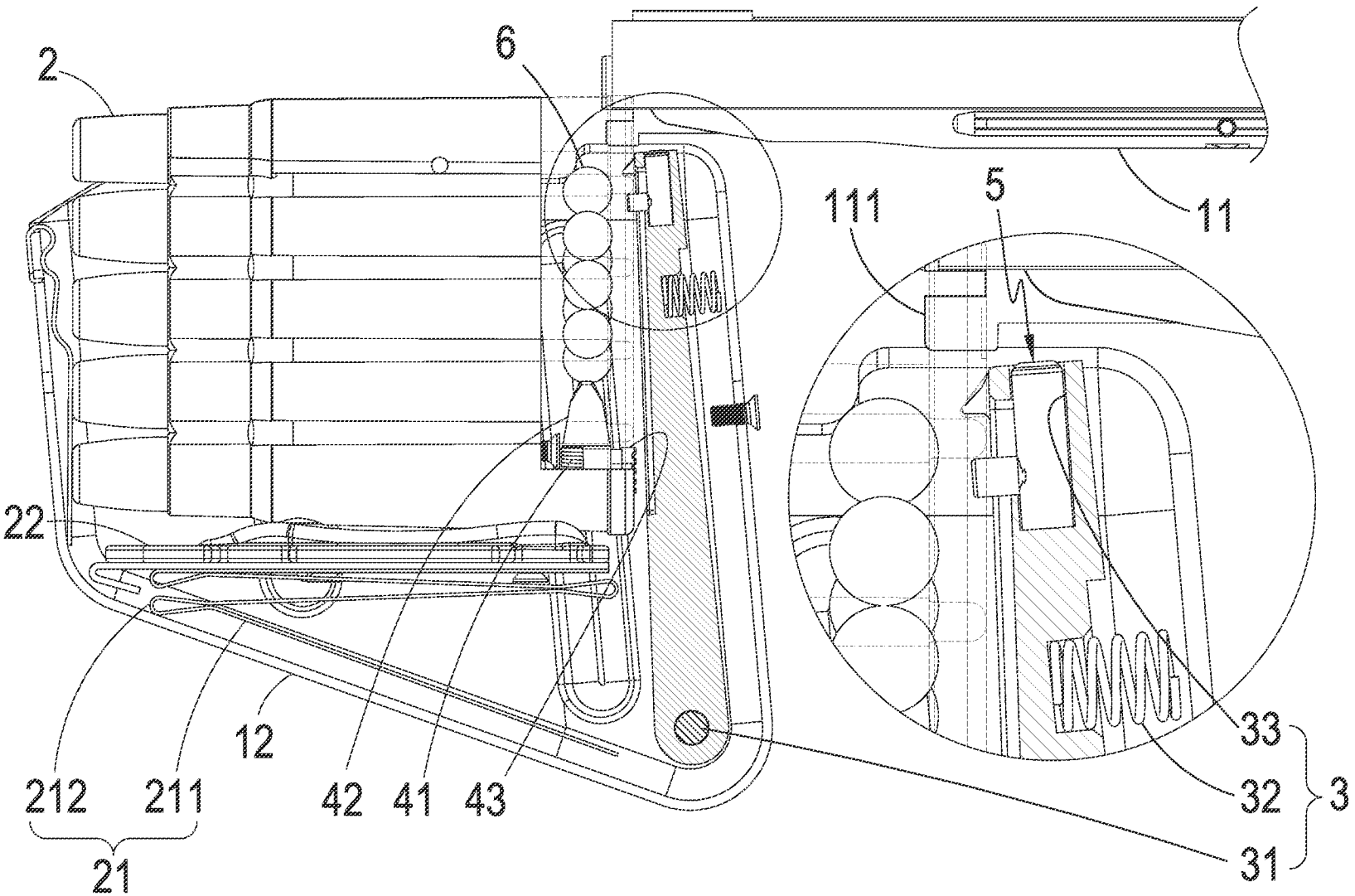
FIG. 2 is a schematic view showing inside structure of an outer casing of a concealed magazine receptacle of the present invention.
Figure 3:
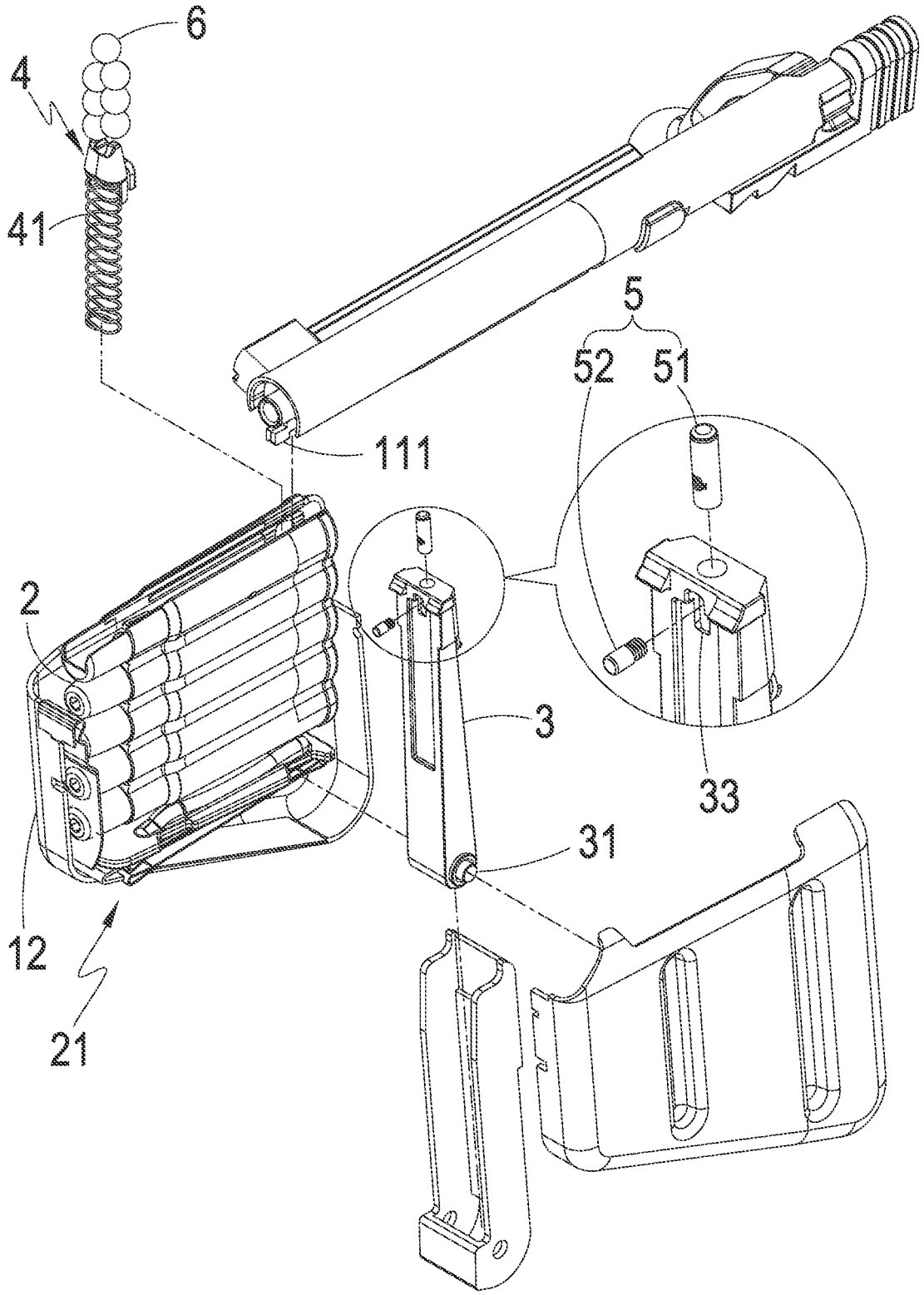
FIG. 3 is an exploded view showing a concealed gun body of the present invention.
Figure 4:
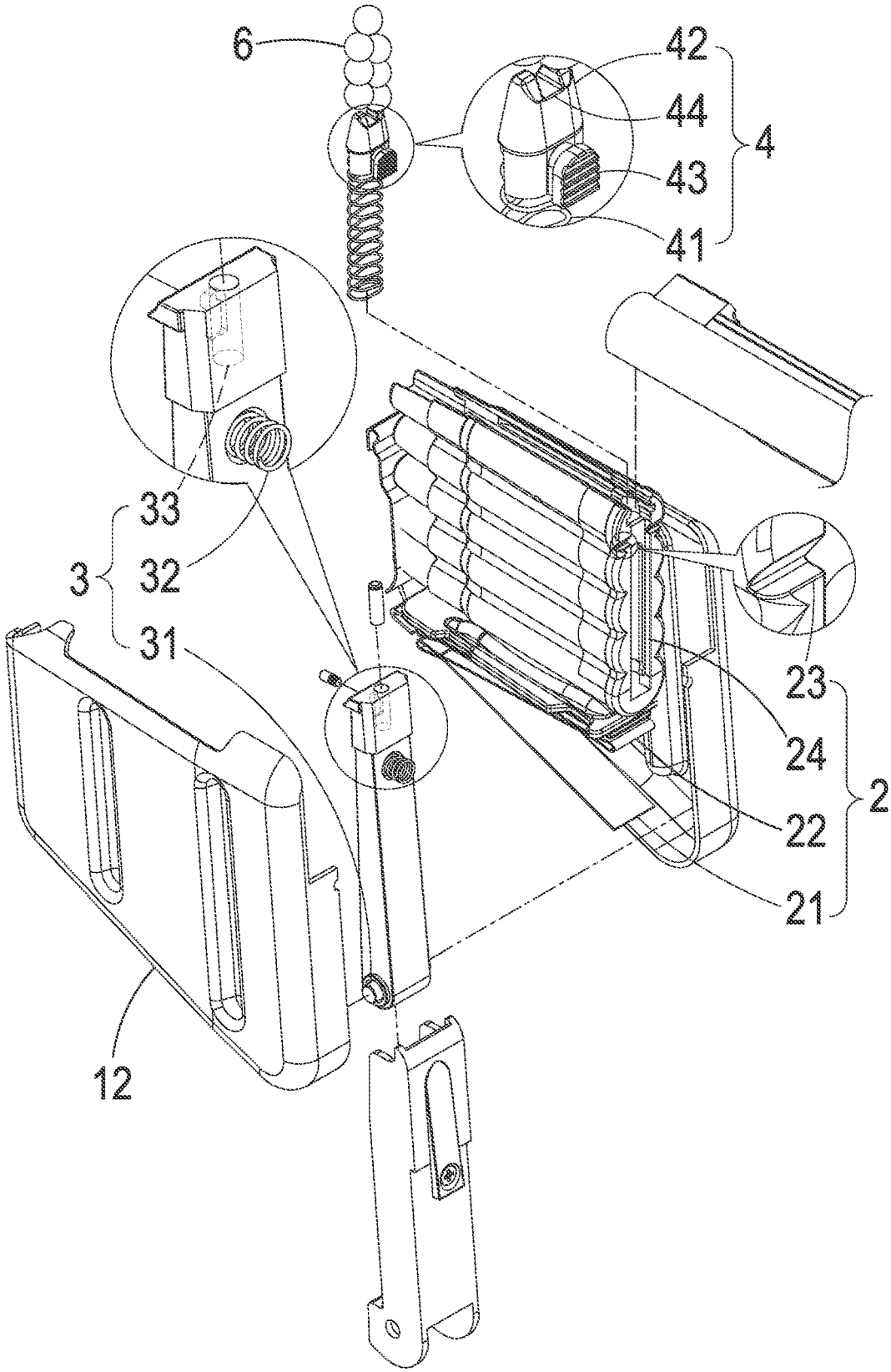
FIG. 4 is an exploded view, taken from a different perspective, illustrating the concealed gun body of the present invention.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

As shown in FIGS. 1-4, the present invention is combinable with a toy gun body 1 that comprises an action structure 11 and generally comprises:

- a magazine receptacle 12, which is formed in an interior of the toy gun body 1;
- at least one pellet holder 2, which is arranged in the magazine receptacle 12 in an elastic manner to receive and hold therein at least one BB or pellet 6, wherein the pellet holder 2 comprises a cartridge elastic member 21 mounted in the magazine receptacle 12 and at least one carrying and supporting member 22 mounted to an end face of the cartridge elastic member 21 to have the pellet holder 2 carried and supported, wherein the cartridge elastic member 21 comprises a plurality of elastic plates 211 and at least one elastic bending section 212 connected between every two adjacent ones of the elastic plates 211;
- a slide chute 24, which is formed in one side of the pellet holder 2;
- a holder latch 3, which is pivotally arranged at one side of the pellet holder 2 in an elastic manner to selectively engage and retain the pellet holder 2 to prevent ejection thereof out of the magazine receptacle 12;
- at least one pellet retainer 23, which is arranged on the pellet holder 2 at a location adjacent to one side of the holder latch 3 to correspond to and engage with the holder latch 3;
- a pivoting section 31, which is provided at one end of the holder latch 3 and is located at one side of the magazine receptacle 12;
- at least one latch elastic member 32, which is arranged at one side of the holder latch 3 that is distant from the pellet holder 2 for selectively pushing the holder latch 3 to elastically swing in a direction toward the pellet holder 2;
- a pellet advancing member 4, which is arranged in the pellet holder 2 in an elastic manner to outward feed the BB or pellet 6, wherein the pellet advancing member 4 comprises a carrying seat 42, at least one action avoiding section 44 formed on the carrying seat 42, and a pushing section 43 arranged at one side of the carrying seat 42 and slidable in and along the slide chute 24 to push an extendible pushing rod 5 to be described hereinafter (wherein in this embodiment, the carrying seat 42 is in the form of a quadrangular pyramid having a top face that is formed with the action avoiding section 44 in the form of a recessed channel to allow the action driving section 111 to pass therethrough);
- a pellet-advancing elastic member 41, which is arranged inside the pellet holder 2 and is connected to a bottom of the pellet advancing member 4;
- an extendible pushing rod 5, which is arranged on the holder latch 3 in an elastic manner and is movable by means of being pushed by the pellet advancing member 4 to partly project out of one side of the holder latch 3, wherein the extendible pushing rod 5 comprises a projection section 51 that selectively projects out of the holder latch 3 to operatively couple to an action driving section 111 to be described hereinafter and a pushed section 52 arranged at one side of the projection section 51 and operable in combination with the pushing section 43; and
- a receiving channel 33, which is formed in the holder latch 3 to receive the extendible pushing rod 5 therein with the pushed section 52 being movably projecting therefrom;
- at least one action driving section 111, which is located at one side of the action structure 11 for driving the extendible pushing rod 5 to move backward in synchronization with and caused by a backward pulling operation of the action structure 11 so as to release the retaining engagement of the holder latch 3 and allow the pellet holder 2 to eject out of the magazine receptacle 12.

As shown in FIGS. 1-11, the toy gun body 1 according to the present invention is exemplified with Mauser Kar98k. Such a firearm comprises a magazine built in an interior thereof and an actual cartridge loading operation is carried out by inserting cartridges one by one into the built-in magazine. One purpose of this invention is made for simulating the cartridge loading operation of such a direct-loading type firearm, but is not limited to such a model of firearm.

Figure 5:
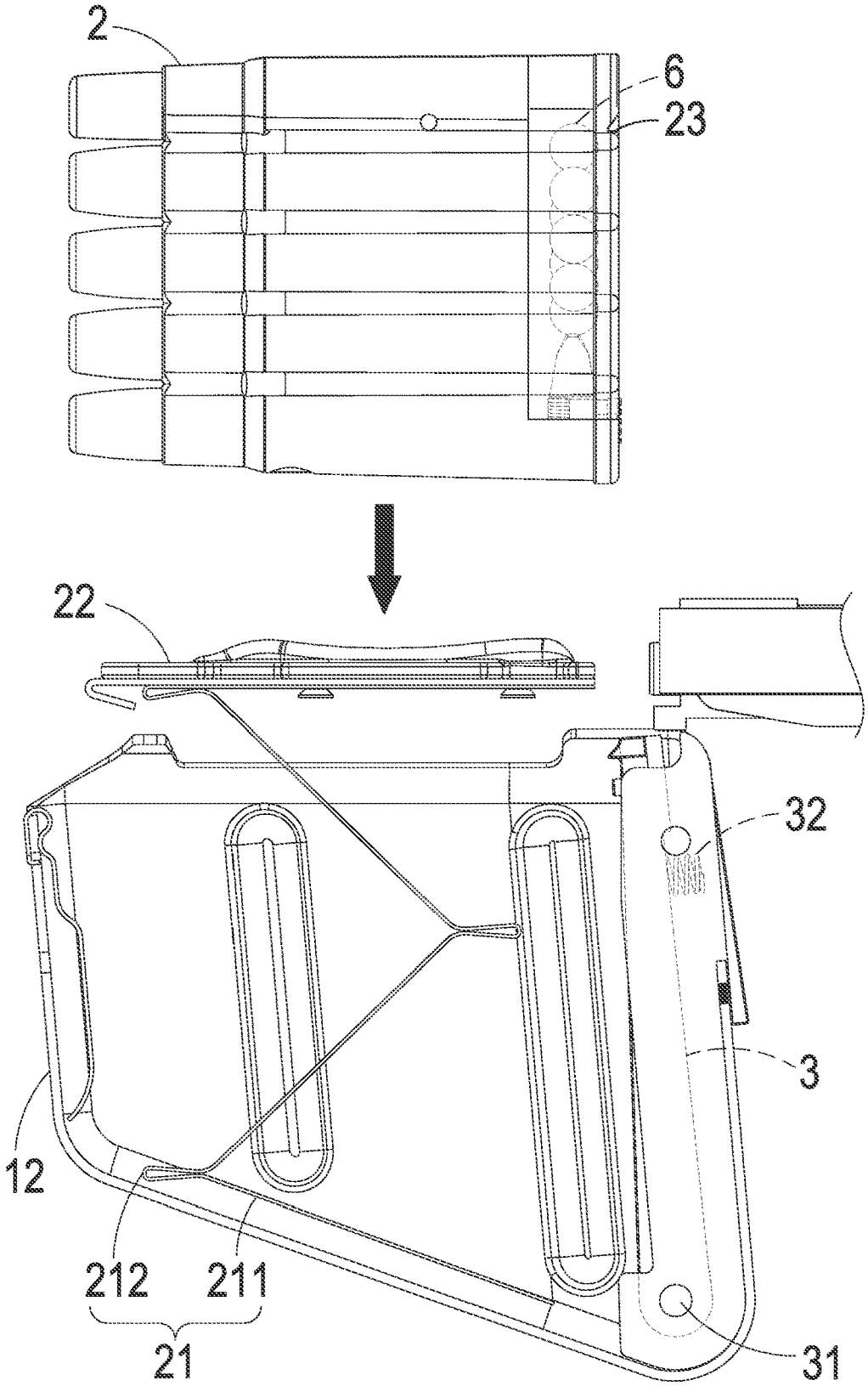
FIG. 5 is a schematic view demonstrating loading of a pellet holder of the preferred embodiment of the present invention.
Figure 6:
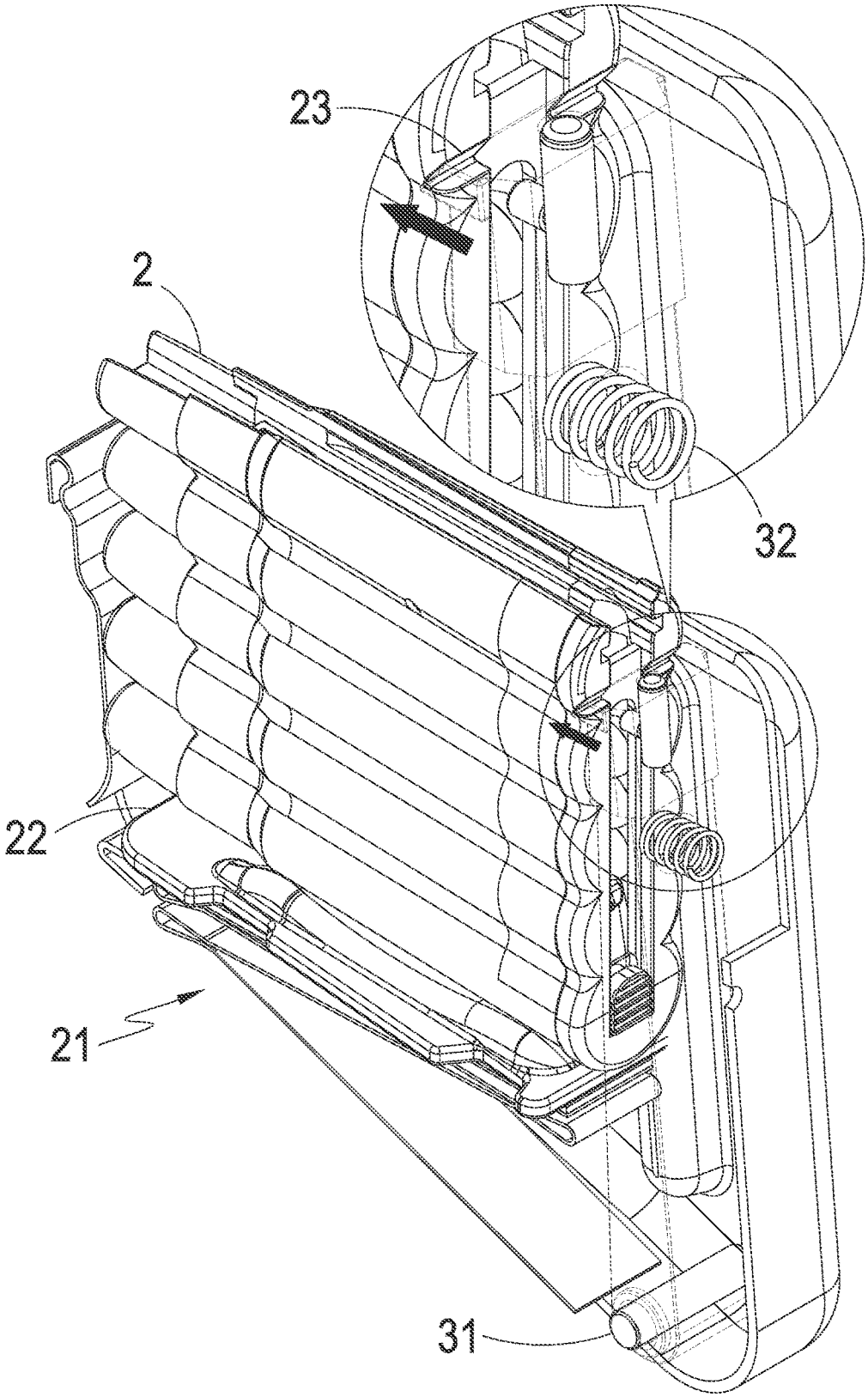
FIG. 6 is another schematic view demonstrating loading of the pellet holder of the preferred embodiment of the present invention.
Figure 7:
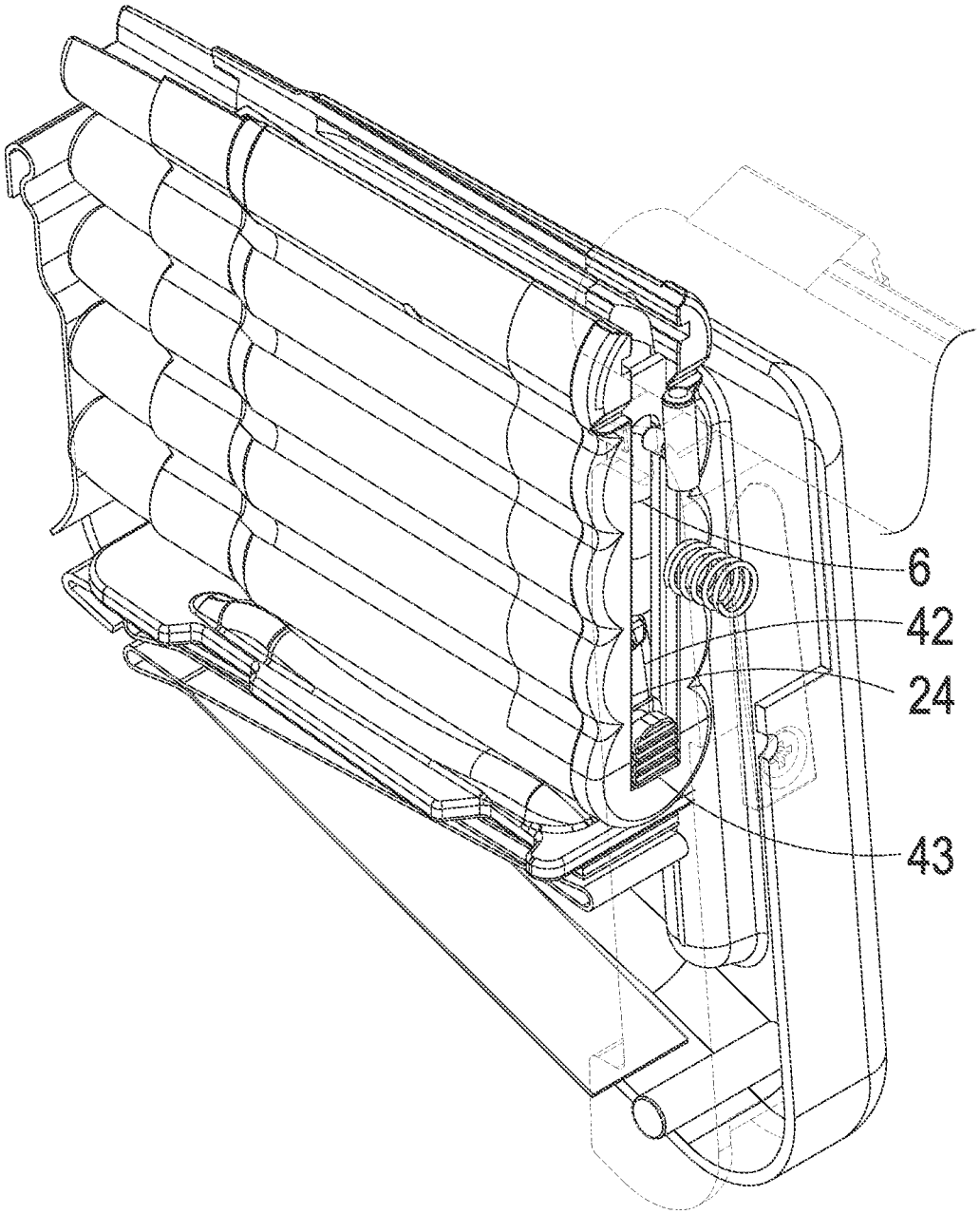
FIG. 7 is a schematic view illustrating a condition of use of the preferred embodiment of the present invention.

In an actual operation, as shown in FIGS. 5-6, the toy gun body 1 has a magazine receptacle 12, but it is provided for receiving and holding a pellet holder 2 that is structured to mimic actual cartridges, and BBs or pellets 6 are received and held in the pellet holder 2. Thus, with the BBs or pellets 6 completely loaded in the pellet holder, a user is allowed to conduct an operation that simulates an actual cartridge loading operation. In this embodiment, the pellet holder 2 is exemplified with an outside configuration that mimics actual cartridges, in order to provide a more realistic simulation operation. The pellet holder 2 is then disposed into the magazine receptacle 12 and compressing, in a downward direction, the cartridge elastic member 21, so that during such a process of downward compressing, since the latch elastic member 32 consistently biases the holder latch 3 in a direction toward the pellet holder 2, causing the holder latch 3 to swing about a center axis defined by the pivoting section 31 (wherein the latch elastic member 32 can be a soft, elastic body, or a spring as shown in the drawings). When the pellet holder 2 is downward moved to a predetermined location, the holder latch 3 is set into engagement with and thus fixes the pellet retainer 23, so that through the engagement between the holder latch 3 and the pellet retainer 23, the pellet holder 2 is retained in position inside the magazine receptacle 12, wherein the pellet holder 2 can be made as an extension or compression spring or can alternatively be structured as an elastic body to eliminate the arrangement of the cartridge elastic member 21, or can even be structured in the form of a M-shape or a lightning configuration made up of a plurality of elastic plates 211 and elastic bending sections 212, so that two of the elastic plates 211 that are set at two ends of the cartridge elastic member 21 are respectively fixed to or attached to or coupled to a bottom of the magazine receptacle 12 and a bottom of the pellet holder 2 and in addition, the elastic plate 211 that is attached to the pellet holder 2 is provided with at least one carrying and supporting member 22 for more stably keeping the position of the pellet holder 2. As such, in the mounting process (or a subsequent ejection process), mounting the pellet holder 2 can be smoothly moved into and out of the magazine receptacle 12 to thereby reduce wear and abrasion of the pellet holder 2.

Figure 8:
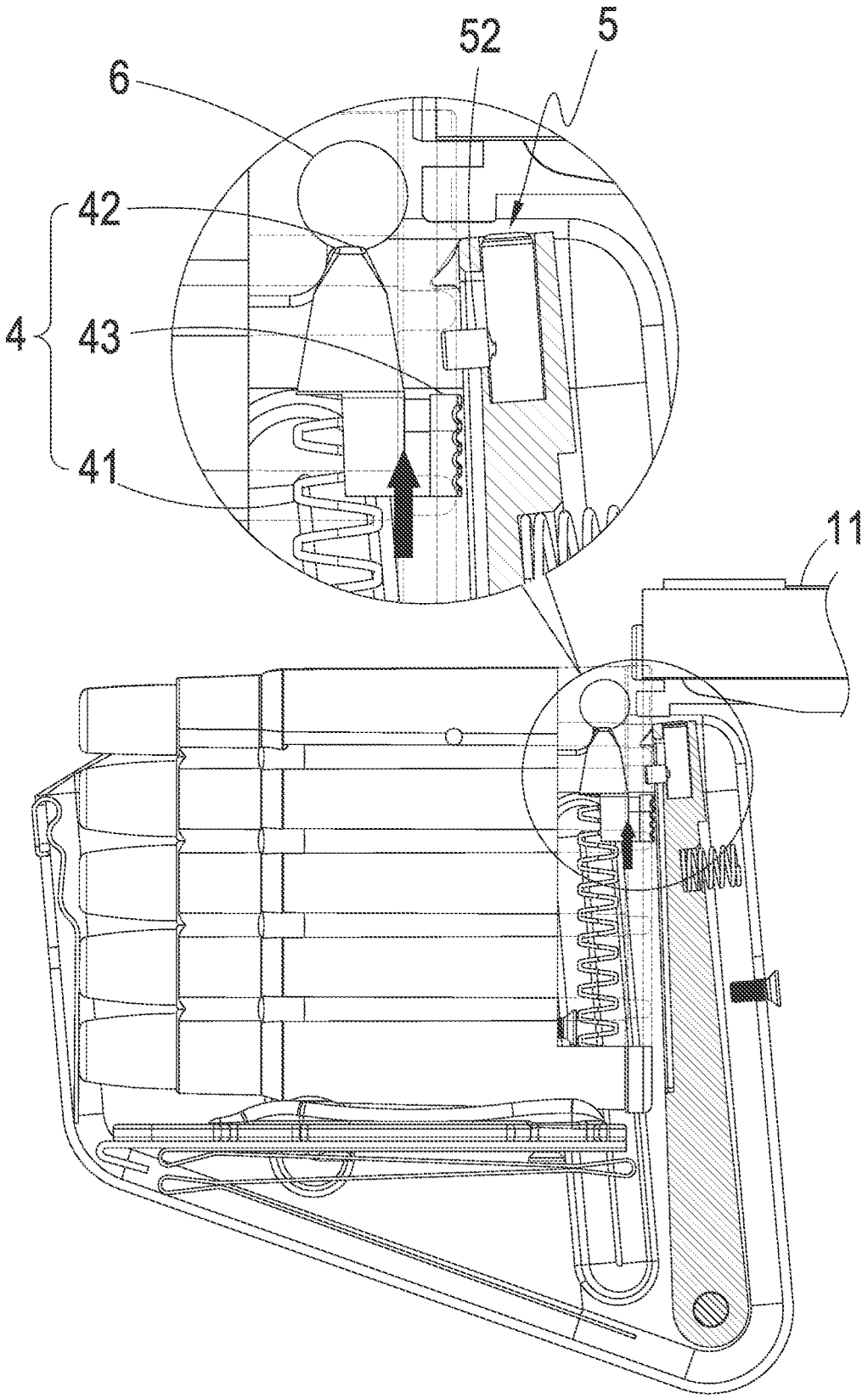
FIG. 8 is a schematic view demonstrating operation of the preferred embodiment of the present invention.
Figure 9:
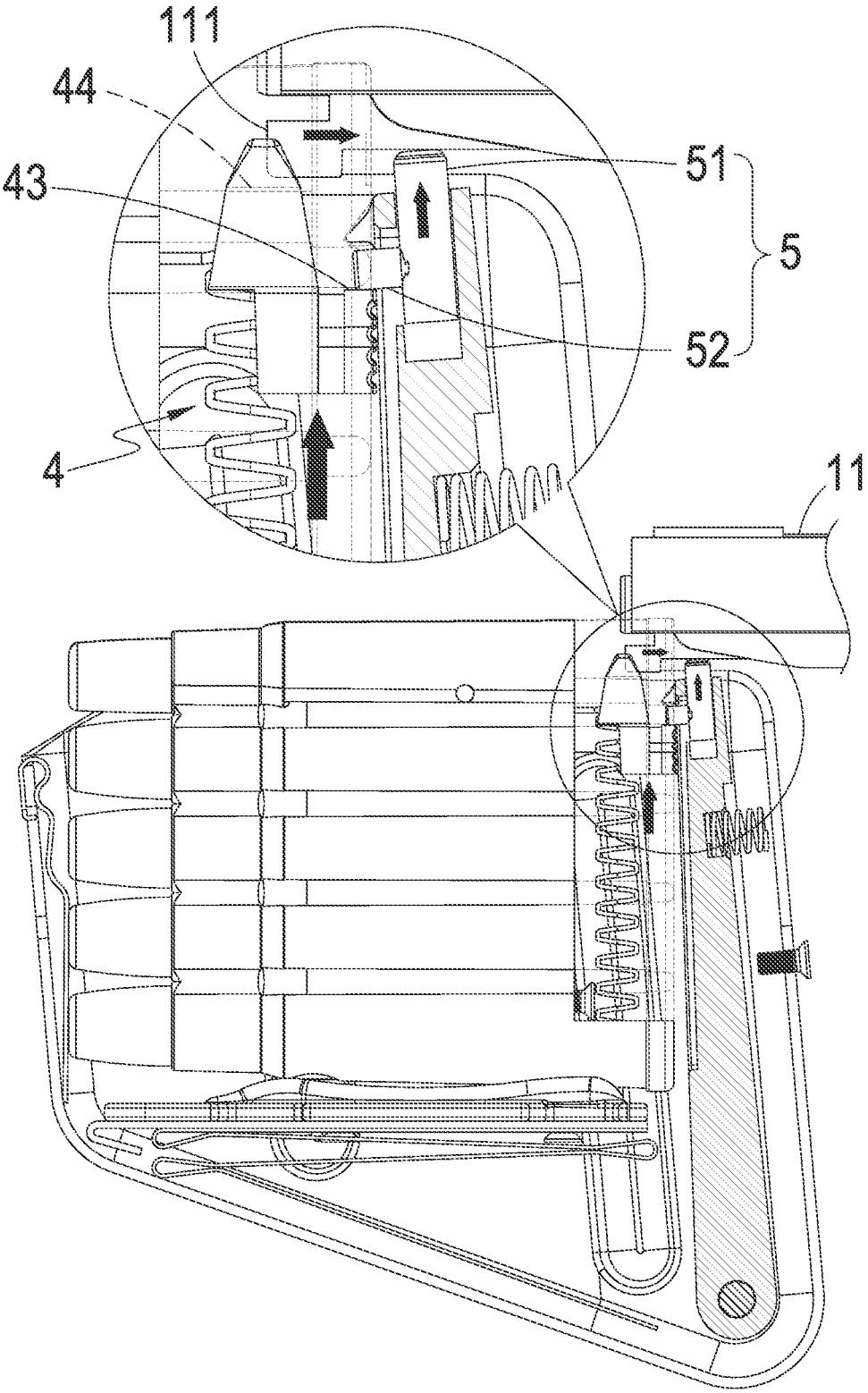
FIG. 9 is another schematic view demonstrating the operation of the preferred embodiment of the present invention.
Figure 10:
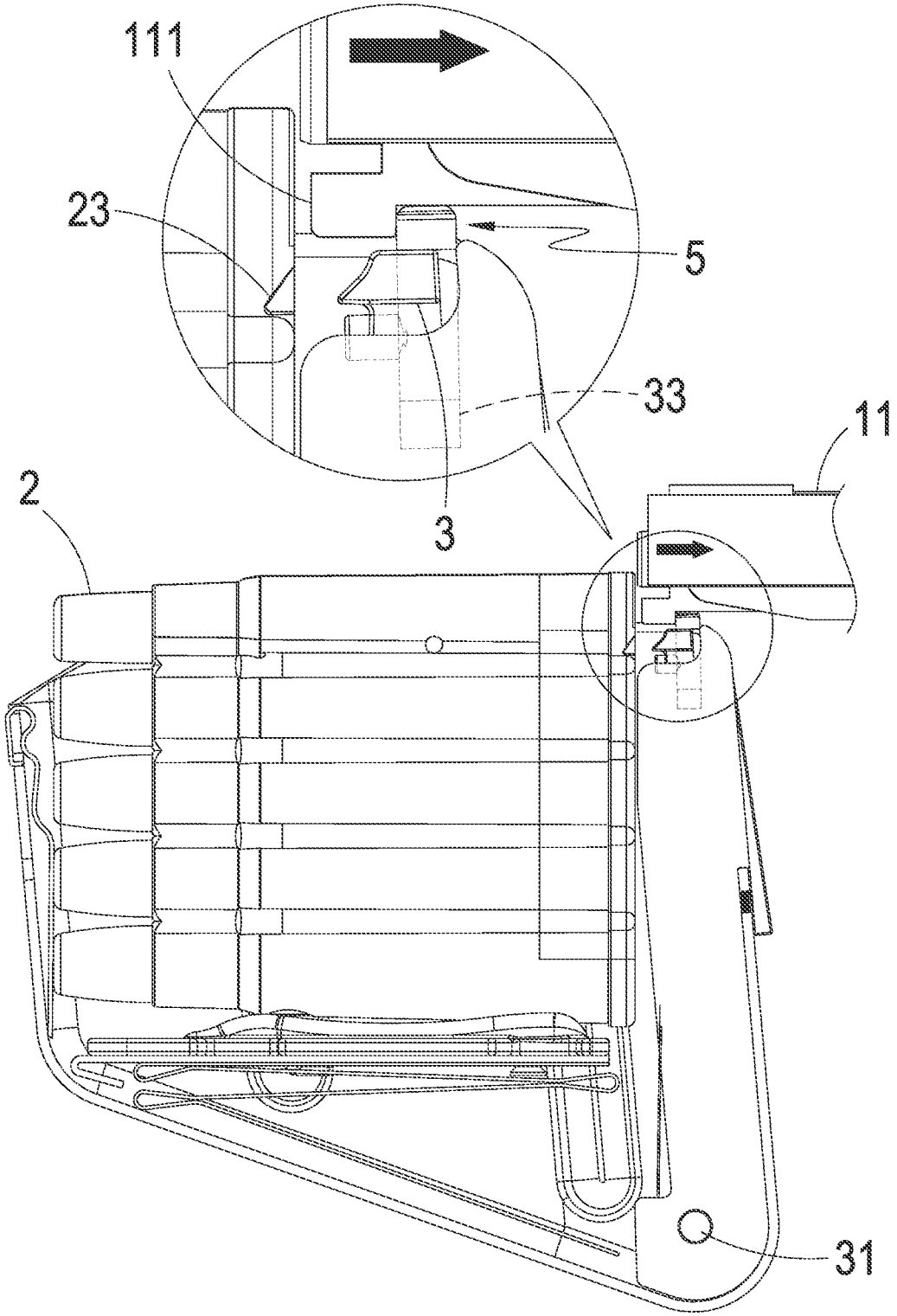
FIG. 10 is a schematic view demonstrating an action driving operation of the preferred embodiment of the present invention.
Figure 11:
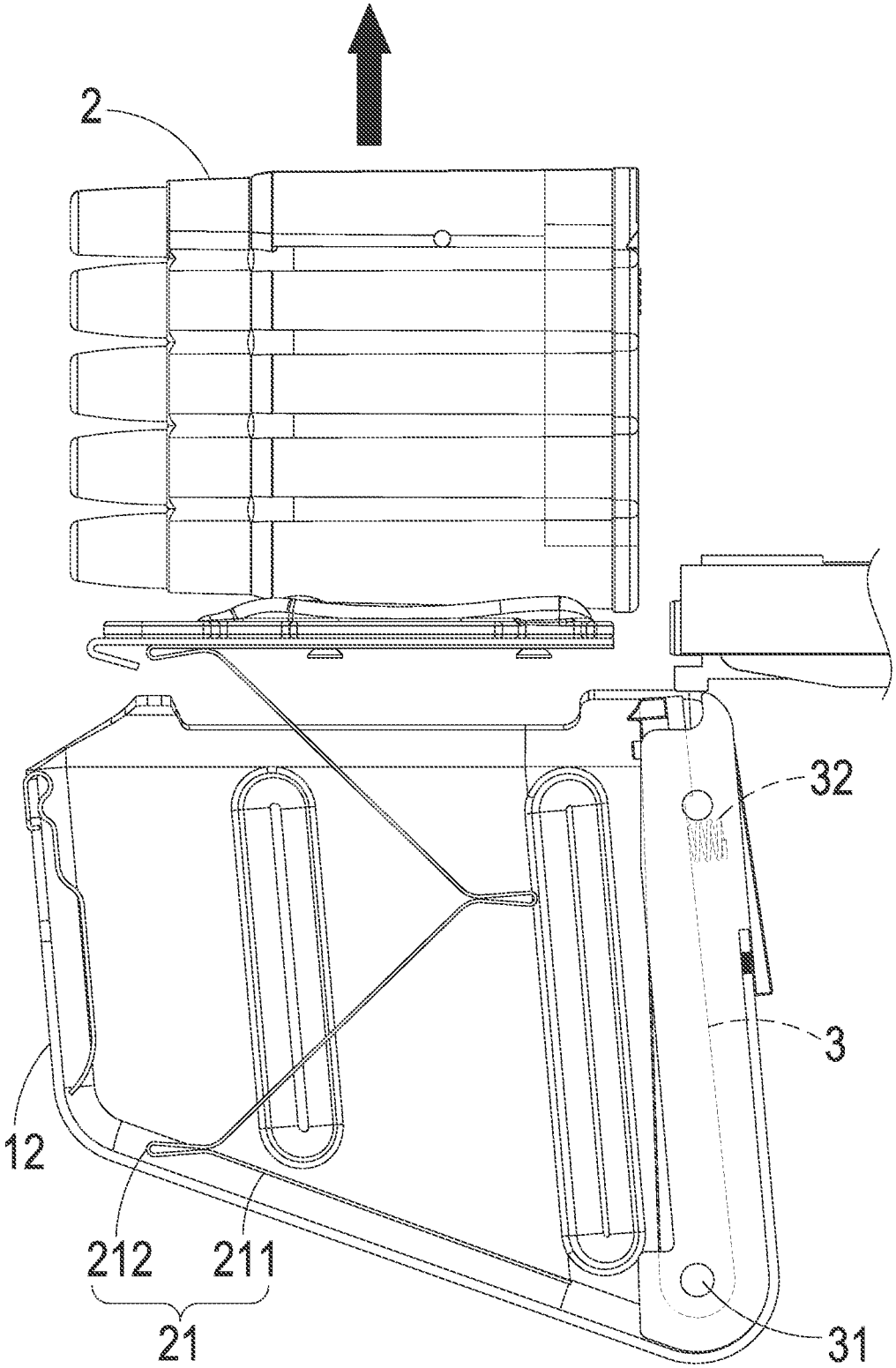
FIG. 11 is a schematic view demonstrating automatic ejection of the preferred embodiment of the present invention.

After the above process of mounting and assembly, the toy gun body 1 is allowed to normally operate. In a process of shooting BBs or pellets 6, as shown in FIGS. 8-9, the BBs or pellets 6 are advanced by the pellet-advancing elastic member 41 upward pushing the carrying seat 42 to advance upward the BBs or pellets 6 one by one. At the time when the last pellet is shot, the pellet advancing member 4 is raised to a location at one side of the extendible pushing rod 5 so that after the last shot of the BB or pellet 6, the pellet advancing member 4 gets into contact with and thus pushes upward the extendible pushing rod 5, wherein the pushing section 43 of the pellet advancing member 4 that slides upward along the slide chute 24 is brought into contact with the pushed section 52 of the extendible pushing rod 5 to drive the projection section 51 of the extendible pushing rod 5 to project out of the holder latch 3 and get into engagement with one side of the action structure 11.

Afterwards, due to the BBs or pellets 6 running out, for an operation after an actual situation of running out of actual cartridges, the action structure 11 is pulled backward to have the action structure 11 retained at the backward site in order to enable loading of actual cartridges. To simulate such an operation of the action structure 11, this invention allows the operation of the action structure 11 being pulled backward by the user to simultaneously drive the action driving section 111 to move backward, so that when the action driving section 111 moves through and contact the pellet advancing member 4, the action driving section 111 is allowed to move through the action avoiding section 44 so as to have the action driving section 111 smoothly pass the pellet advancing member 4 and, at the same time of passing, the pellet advancing member 4 is allowed to raise again to have the pushing section 43 contact the pushed section 52, causing the projection section 51 to project out of the holder latch 3. Under such a condition, the action driving section 111 pushes the projection section 51 of the extendible pushing rod 5 backwards and the holder latch 3 is driven by the extendible pushing rod 5 to rotate about the rotation axis defined by the pivoting section 31 in a reversed direction, so that through the reversed direction swing of the holder latch 3, the retaining engagement of the pellet retainer 23 of the pellet holder 2 is released and the pushed section 52 disengages from and separates from the pushing section 43. The extendible pushing rod 5 being of a cylindrical configuration, resistance against free falling of the extendible pushing rod 5 in the receiving channel 33 after the separation can be reduced. Finally, an elastic force of the cartridge elastic member 21 ejects the pellet holder 2 out of the magazine receptacle 12. As such, the operation of the action structure 11 is used to also move the holder latch 3 for achieving automatic ejection of the pellet holder 2, whereby an action to carry out such an operation is simplified and simulation of an operation of an actual firearm can be made better.

After re-loading of BBs or pellets 6, the action structure 11 is moved forward and the holder latch 3 is caused to swing by the latch elastic member 32. Since the pellet advancing member 4 is now not in pushing contact with the pushed section 52, the pushed section 52 is moved into the slide chute 24 to await a next loading operation of BBs or pellets 6.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. An automatic magazine ejection structure, which is combinable with a toy gun body that comprises an action structure, the structure comprising:

a magazine receptacle, which is formed in an interior of the toy gun body;

at least one pellet holder, which is arranged in the magazine receptacle in an elastic manner to receive and hold therein at least one BB or pellet;

a holder latch, which is pivotally arranged at one side of the pellet holder in an elastic manner to selectively engage and retain the pellet holder to prevent ejection thereof out of the magazine receptacle;

a pellet advancing member, which is arranged in the pellet holder in an elastic manner to outward feed the BB or pellet;

a pellet-advancing elastic member, which is arranged inside the pellet holder and is connected to a bottom of the pellet advancing member;

an extendible pushing rod, which is arranged on the holder latch in an elastic manner and is movable by means of being pushed by the pellet advancing member to partly project out of one side of the holder latch; and at least one action driving section, which is located at one side of the action structure for driving the extendible pushing rod to move backward in synchronization with and caused by a backward pulling operation of the action structure so as to release the retaining engagement of the holder latch and allow the pellet holder to eject out of the magazine receptacle.

2. The automatic magazine ejection structure according to claim 1, wherein the pellet holder comprises a cartridge elastic member mounted in the magazine receptacle and at least one carrying and supporting member mounted to an end face of the cartridge elastic member to have the pellet holder carried and supported.

3. The automatic magazine ejection structure according to claim 2, wherein the cartridge elastic member comprises a plurality of elastic plates and at least one elastic bending section connected between every two adjacent ones of the elastic plates.

4. The automatic magazine ejection structure according to claim 1, wherein the pellet holder is provided with at least one pellet retainer, which is arranged at a location adjacent to one side the holder latch to correspond to and engage with the holder latch.

5. The automatic magazine ejection structure according to claim 1, wherein the holder latch has an end that comprises a pivoting section located at one side of the magazine receptacle, and the holder latch is provided, at one side thereof that is distant from the pellet holder, with at least one latch elastic member for selectively pushing the holder latch to elastically swing in a direction toward the pellet holder.

6. The automatic magazine ejection structure according to claim 1, wherein the pellet advancing member comprises a carrying seat, at least one action avoiding section formed on the carrying seat, and a pushing section arranged at one side of the carrying seat for pushing the extendible pushing rod.

7. The automatic magazine ejection structure according to claim 6, wherein the extendible pushing rod comprises a projection section that selectively projects out of the holder latch to operatively couple to an action driving section to be described hereinafter and a pushed section arranged at one side of the projection section and operable in combination with the pushing section.

8. The automatic magazine ejection structure according to claim 7, wherein the pellet holder comprises a slide chute formed in one side thereof for sliding of the pushing section, the pushed section being selectively moved into the slide chute.

9. The automatic magazine ejection structure according to claim 7, wherein the holder latch comprises a receiving channel formed therein for receiving the extendible pushing rod therein with the pushed section being movably projecting therefrom.

* * * * *